US012516846B2

(12) United States Patent
Rybacki

(10) Patent No.: US 12,516,846 B2
(45) Date of Patent: Jan. 6, 2026

(54) DIVERTER FOR A JET HEATER DEVICE

(71) Applicant: Guy Rybacki, Greenwood, DE (US)

(72) Inventor: Guy Rybacki, Greenwood, DE (US)

( * ) Notice: Subject to any disclaimer, the term of this patent is extended or adjusted under 35 U.S.C. 154(b) by 641 days.

(21) Appl. No.: 17/845,203

(22) Filed: Jun. 21, 2022

(65) Prior Publication Data

US 2023/0266039 A1 Aug. 24, 2023

Related U.S. Application Data

(60) Provisional application No. 63/312,245, filed on Feb. 21, 2022.

(51) Int. Cl.
*F24H 9/00* (2022.01)
*F24H 3/02* (2022.01)

(52) U.S. Cl.
CPC ..... *F24H 9/0057* (2013.01); *F24H 3/02* (2013.01)

(58) Field of Classification Search
CPC ..... F24H 9/0057; F24H 3/02
USPC ..... 126/249
See application file for complete search history.

(56) References Cited

U.S. PATENT DOCUMENTS 1,372,470 A * 3/1921 Zimmermann ..... F24C 3/042 126/249
1,913,124 A * 6/1933 Lawner ..... A61M 11/041 392/335
3,221,730 A * 12/1965 Hughes ..... F24H 9/0052 126/307 R
4,081,238 A * 3/1978 Briggs ..... F24C 5/10 432/222
8,047,197 B1 * 11/2011 Zernich ..... F24C 15/22 126/92 AC
9,267,704 B1 * 2/2016 Lee, Jr. ..... F24H 3/02
2012/0308214 A1 * 12/2012 Tyburk ..... F24F 1/032 392/407
2016/0206075 A1 * 7/2016 Stephens ..... A45D 20/12
(Continued)

FOREIGN PATENT DOCUMENTS

CA 2709058 A1 * 1/2012 ..... F24H 3/02
CN 105466021 A * 4/2016 ..... F24H 3/02
CN 208198038 U * 12/2018 ..... B60H 1/00
(Continued)

OTHER PUBLICATIONS

Yacoubou, Jeanne, 5 Major Types of Renewable Energy [+2 Under Development], 19 pages, https://greencoast.org/types-of-renewable-energy/ (Year: 2020).*
(Continued)

*Primary Examiner* — Michael G Hoang
*Assistant Examiner* — Elizabeth Ann Laughlin
(74) *Attorney, Agent, or Firm* — Brennan, Manna & Diamond, LLC

(57) ABSTRACT

The present invention relates to a novel diverter device. The device provides users with a removable and repositionable diversion attachment, which is secured to a jet heater, or other portable heating unit. The diverter device comprises a generally U-shaped component of stainless steel that is attached to the jet heater via a clamp, or other attachment means, allowing users to reposition the device as needed. The device allows the user to adjust the airflow from the jet heater in several different ways by simply rotating or repositioning the U-shaped component.

5 Claims, 6 Drawing Sheets

(56) References Cited

U.S. PATENT DOCUMENTS

2019/0301740 A1* 10/2019 Daniels ..... F23C 3/002

FOREIGN PATENT DOCUMENTS

| | | | | | |
|---|---|---|---|---|---|
| CN | 109795290 | A | * | 5/2019 | ..... B60H 1/34 |
| GB | 2474055 | A | * | 4/2011 | ..... F24C 5/20 |
| KR | 20160090642 | A | * | 8/2016 | ..... F04D 25/08 |
| WO | WO-2019107861 | A1 | * | 6/2019 | ..... F24F 13/02 |

OTHER PUBLICATIONS

Chinese to English machine translation for CN105466021A.*
Korean to English machine translation for KR20160090642A.*
Chinese to English machine translation of CN109795290A.*
Chinese to English machine translation of CN208198038U.*
Korean to English machine translation of WO2019107861A1.*
Merriam-Webster, Bolt, 1 page, https://www.merriam-webster.com/dictionary/bolt.*
Merriam-Webster, Bracket, 1 page, https://www.merriam-webster.com/dictionary/bracket.*
Merriam-Webster, Clamp, 1 page, https://www.merriam-webster.com/dictionary/clamp.*
Menards, Hex Bolt, 1 page,https://www.menards.com/main/hardware/fasteners-connectors/bolts/cap-screws-hex-bolts/midwest-fastener-reg-3-8-16-x-1-nylon-hex-bolt-8-count/77102/p-1444439991169-c-8730.htm.*

* cited by examiner

DIVERTER FOR A JET HEATER DEVICE

CROSS-REFERENCE TO RELATED APPLICATION

The present application claims priority to, and the benefit of, U.S. Provisional Application No. 63/312,245, which was filed on Feb. 21, 2022 and is incorporated herein by reference in its entirety.

FIELD OF THE INVENTION

The present invention relates generally to the field of jet heater diverters. More specifically, the present invention relates to an improved diverter device that provides users with a repositionable diversion attachment for a jet heater. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in jet heaters of the type which are used to heat indoor and/or outdoor areas and people. When using a jet heater, the airflow may remain low to the ground, focused on a user's feet and knees. Thus, users may not be able to get properly warm due to the heat being diverted toward the ground area. Spreading the heat across a user's body as opposed to near the feet and knees can make users more comfortable.

Furthermore, conventional jet heaters are cumbersome and difficult to reposition when needed. Constantly bending down toward the jet heater can be frustrating, uncomfortable, and difficult for users with back and knee pain. Further, typically repositioning jet heaters still does not allow for airflow to be diverted upwards, but instead airflow remains low to the ground.

Thus, it is necessary for users to divert airflow from a jet heater to spread heat across a user's body as opposed to near the feet and knees. Generally, conventional jet heaters are difficult to reposition, and a user may not be able to get properly warm due to the heat being diverted toward the ground area. Therefore, users require a diverter device that offers a way for users to maintain the desired heat when using a jet heater.

Therefore, there exists a long-felt need in the art for a diverter device that provides users with a repositionable diversion attachment for jet heaters. There is also a long-felt need in the art for a diverter device that allows users to rotate or reposition the diverter attachment as needed to divert heat in a desired direction. Further, there is a long-felt need in the art for a diverter device that utilizes a U-shaped piece of stainless steel to divert heat toward the upper area of the body. Moreover, there is a long-felt need in the art for a device that offers a way for users to maintain desired heat when using a jet heater. Further, there is a long-felt need in the art for a diverter device that spreads heat across a user's body, as opposed to near the feet and knees to make users more comfortable. Finally, there is a long-felt need in the art for a diverter device that prevents users from unnecessary repositioning of the jet heater which can cause injuries.

The subject matter disclosed and claimed herein, in one embodiment thereof, comprises a diverter device. The device provides users with a removable and repositionable diversion attachment, which is secured to a jet heater, or other portable heating unit. The diverter device comprises a generally U-shaped component of stainless steel that is attached to the jet heater via a clamp, or other attachment means, allowing users to reposition the device as needed. The device allows the user to adjust the airflow from the jet heater in several different ways by simply rotating or repositioning the U-shaped component.

In this manner, the diverter device of the present invention accomplishes all of the foregoing objectives and provides users with a device that offers a way for users to maintain the desired heat when using a jet heater. The device allows a user to rotate or reposition the attachment as needed to divert heat in a desired direction. The device saves time and effort when repositioning a jet heater.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a diverter device. The device provides users with a removable and repositionable diversion attachment, which is secured to a jet heater, or other portable heating unit. The diverter device comprises a generally U-shaped component of stainless steel that is attached to the jet heater via a clamp, or other attachment means, allowing users to reposition the device as needed. The device allows the user to adjust the airflow from the jet heater in several different ways by simply rotating or repositioning the U-shaped component.

In one embodiment, the U-shaped component comprises opposing top and bottom walls, with the top and the bottom walls each comprising a first end and a second end. The first end of the top wall and the first end of the bottom wall are secured together via a rounded side wall, creating a generally U-shaped structure, which is open in the center allowing air to flow through. The top and bottom walls are typically flat, planar structures, but can be any suitable shape or size as is known in the art, depending on the needs and/or wants of a user.

In one embodiment, the second end of the top wall and the second end of the bottom wall are also secured together via a rounded side wall, creating an oval-shaped structure, which is open in the center allowing air to flow through.

In one embodiment, the opposing top and bottom walls are approximately 10-15 inches in length, preferably approximately 12 inches in length, depending on the wants and/or needs of a user, as well as the intended use of the jet heater. Typically, the opposing top and bottom walls are long enough that the walls span the width of the jet heater outlet, allowing the device to be securely attached to the jet heater.

In one embodiment, the device comprises a holding bracket that is secured to the rounded side wall via a bolt, clamp, or other securing device. The securing device allows the U-shaped component to be rotated and/or repositioned by the user, depending on the needs and/or wants of a user. The U-shaped component provides for directed airflow of the jet heater. In one embodiment, the holding bracket extends out approximately perpendicular to the side wall, such that the holding bracket contacts the side of the jet heater, when the device is in position in front of the jet heater outlet. Typically, the holding bracket is approximately between 3-5 inches in length, depending on the needs and/or wants of a user. The holding bracket is removably attached to the side of the jet heater via a screw, bolt, clamp, etc., or any other suitable securing means as is known in the art.

In yet another embodiment, the diverter device is manufactured from stainless steel, aluminum, powder-coated metals, or any other suitable metals as is known in the art.

In another embodiment, the diverter device comprises a plurality of indicia on the U-shaped component.

In yet another embodiment, a method of diverting airflow from a jet heater is described. The method includes the steps of providing a diverter device comprising a U-shaped component that is attached to a jet heater via a clamp. The method also comprises securing the diverter device to the jet heater, such that the user utilizes the clamp to secure the diverter device to the jet heater. Further, the method comprises positioning the diverter device in a desired position for use. Finally, rotating and/or repositioning the diverter device as needed to divert the heat in a desired direction.

In yet another embodiment of the present invention, a diverter device is disclosed for diverting heat from a jet heater. The device comprises a generally stainless-steel U-shaped component that is secured to a jet heater, allowing users to reposition the device as needed. The device allows users to adjust the airflow from a jet heater in several different ways by simply rotating or repositioning the U-shaped component.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
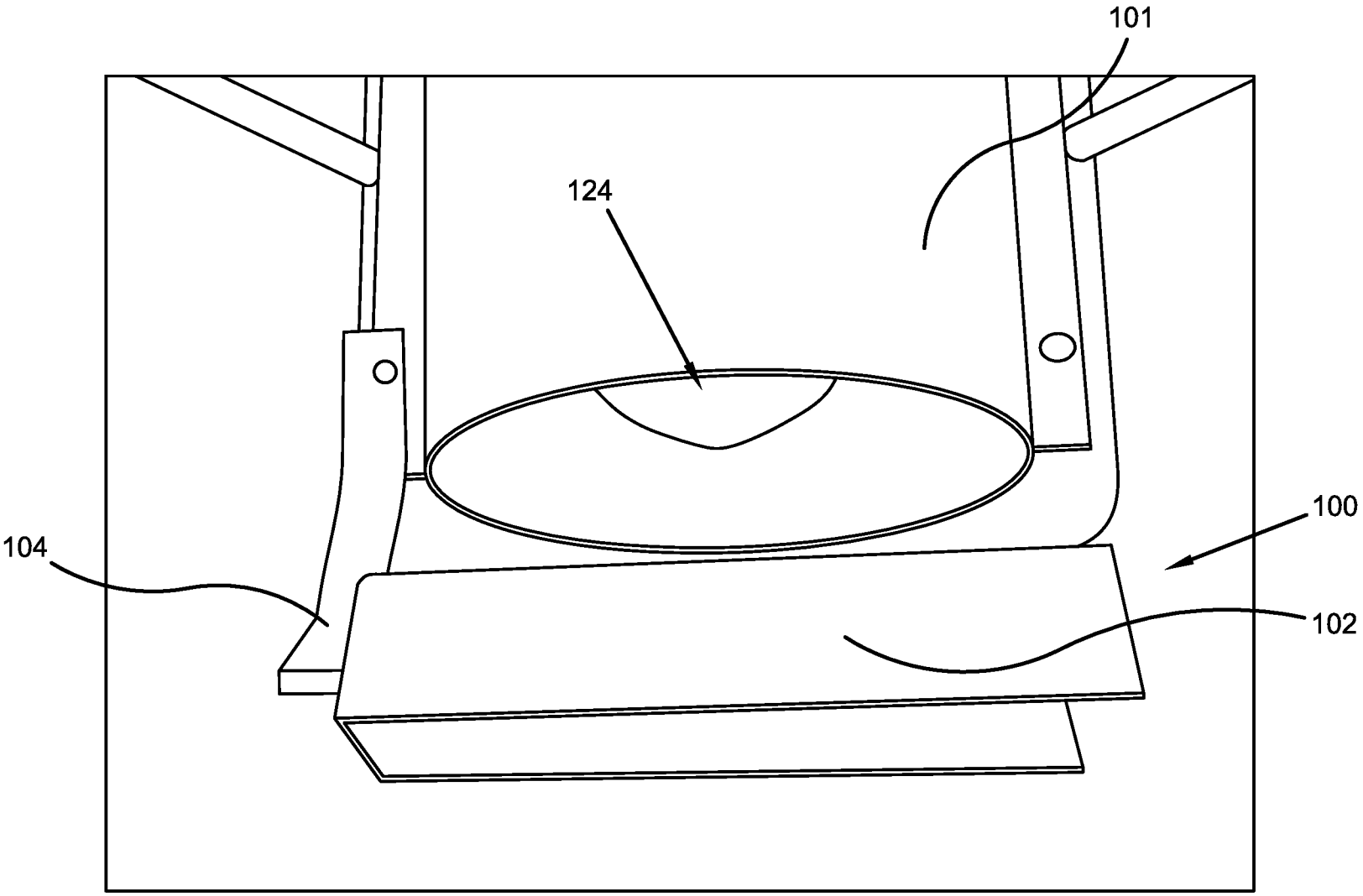
FIG. 1 illustrates a perspective view of one potential embodiment of the diverter device of the present invention secured to a jet heater in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a diverter device that provides users with a repositionable diversion attachment for jet heaters. There is also a long-felt need in the art for a diverter device that allows users to rotate or reposition the diverter attachment as needed to divert heat in a desired direction. Further, there is a long-felt need in the art for a diverter device that utilizes a U-shaped piece of stainless steel to divert heat toward the upper area of the body. Moreover, there is a long-felt need in the art for a device that offers a way for users to maintain desired heat when using a jet heater. Further, there is a long-felt need in the art for a diverter device that spreads heat across a user's body, as opposed to near the feet and knees to make users more comfortable. Finally, there is a long-felt need in the art for a diverter device that prevents users from unnecessary repositioning of the jet heater which can cause injuries.

The present invention, in one exemplary embodiment, is a novel diverter device. The device provides users with a removable and repositionable diversion attachment, which is secured to a jet heater, or other portable heating unit. The diverter device comprises a generally U-shaped component of stainless steel that is attached to the jet heater via a clamp, or other attachment means, allowing users to reposition the device as needed. The present invention also includes a novel method of diverting airflow from a jet heater. The method includes the steps of providing a diverter device comprising a U-shaped component that is attached to a jet heater via a clamp. The method also comprises securing the diverter device to the jet heater, such that the user utilizes the clamp to secure the diverter device to the jet heater. Further, the method comprises positioning the diverter device in a desired position for use. Finally, rotating and/or repositioning the diverter device as needed to divert the heat in a desired direction.

Referring initially to the drawings, FIG. 1 illustrates a perspective view of one embodiment of the diverter device 100 of the present invention. In the present embodiment, the diverter device 100 is an improved diverter device that allows users to rotate or reposition the attachment as needed to divert heat in a desired direction. The device 100 is especially designed to allow any suitable user as is known in the art, to divert heat from a jet heater 101 in a desired direction. Typically, heat is diverted from a jet heater 101, however any suitable portable heating unit can be utilized as is known in the art, depending on the needs and/or wants of a user. More specifically, the device 100 comprises a generally U-shaped component 102 that is attached to a jet heater 101 via a securing component 104, allowing users to reposition the device 100 as needed. The securing component 104 can be any suitable securing means as is known in the art.

Figure 2:
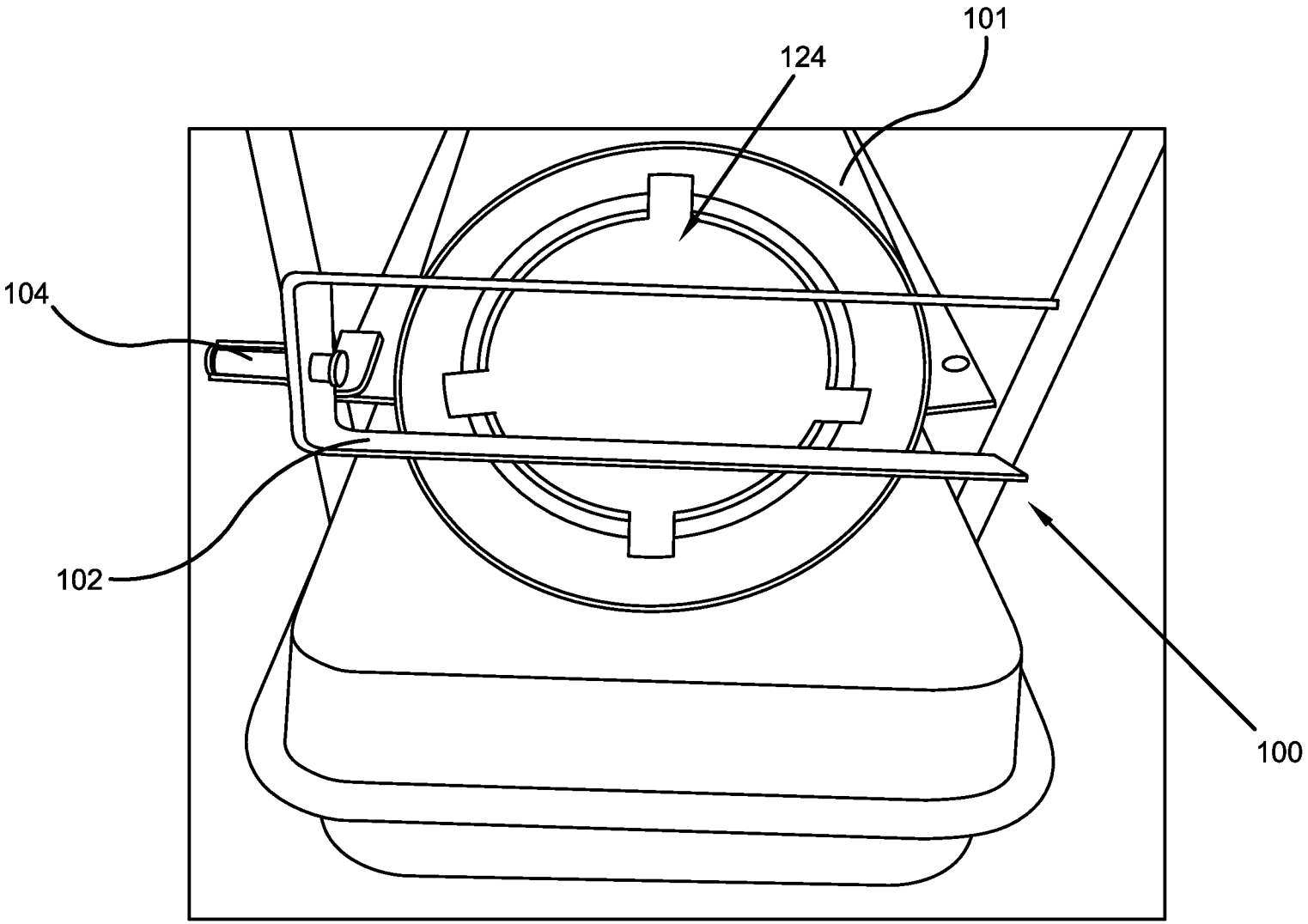
FIG. 2 illustrates a perspective view of one potential embodiment of the diverter device of the present invention in use in accordance with the disclosed architecture.

FIG. 2 illustrates a perspective view of another embodiment of the diverter device 100 of the present invention. In this embodiment, the U-shaped component 102 comprises opposing top 106 and bottom walls 108, wherein each of the top 106 and bottom 108 walls comprise a first end 110, 112 and a second end 114, 116. The first end 110 of the top wall 106 and the first end 112 of the bottom wall 108 are secured together via a rounded side wall 118, creating a generally U-shaped structure, which is open in the center 120 allowing air to flow through. Further, the top 106 and bottom 108 walls are typically flat, planar structures, but can be any suitable shape or size as is known in the art, depending on the needs and/or wants of a user.

In another embodiment, the second end 114 of the top wall 106 and the second end 116 of the bottom wall 108 are also secured together via a second rounded side wall 122, creating an oval-shaped structure, which is open in the center 120 allowing air to flow through.

In yet another embodiment, the opposing top and bottom walls 106 and 108 are approximately 10-15 inches in length, preferably approximately 12 inches in length, depending on the wants and/or needs of a user, as well as the intended use of the jet heater 101. Typically, the opposing top 106 and bottom walls 108 are long enough that the walls 106, 108 span the width of the jet heater outlet 124, allowing the device 100 to be securely attached to the jet heater 101.

Figure 3:
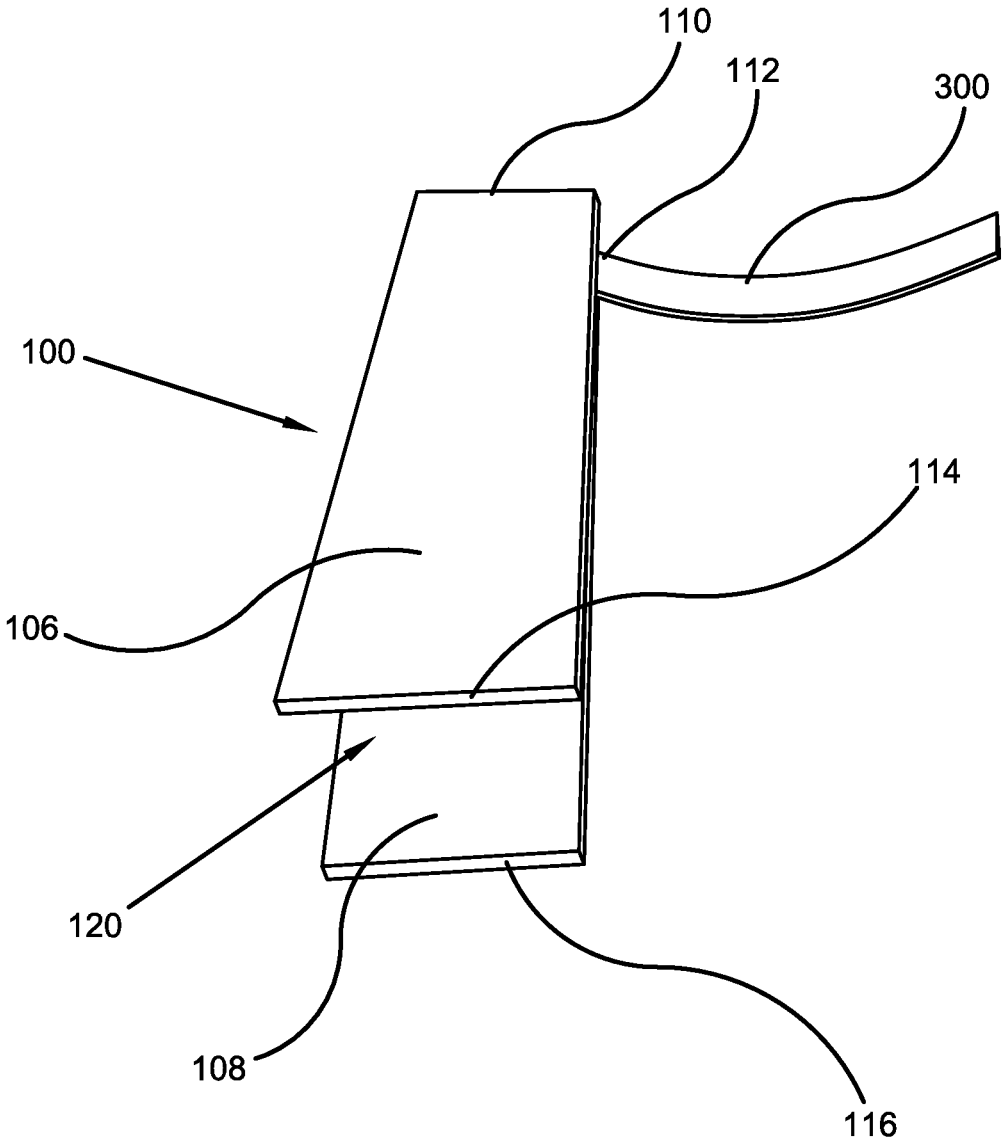
FIG. 3 illustrates a side perspective view of one potential embodiment of the diverter device of the present invention in accordance with the disclosed architecture.

FIG. 3 illustrates a perspective view of another embodiment of the diverter device 100 of the present invention. In this embodiment, the device 100 comprises a holding bracket 300 that is secured to the rounded side wall 118 via a bolt, clamp, or other securing device 302. Any suitable securing device 302 can be utilized as is known in the art, depending on the needs and/or wants of a user. The securing device 302 allows the U-shaped component 102 to be rotated and/or repositioned by the user, depending on the needs and/or wants of a user. Specifically, the securing device 302 allows the U-shaped component 102 to be pivoted up and down, as well as rotated right and left. Once in a desired position, the U-shaped component 102 provides for directed airflow of the jet heater 101. In one embodiment, the holding bracket 300 extends out approximately perpendicular to the side wall 118, such that the holding bracket 300 contacts the side of the jet heater 101, when the device 100 is in position in front of the jet heater outlet 124. Typically, the holding bracket 300 is approximately between 3-5 inches in length, depending on the needs and/or wants of a user. In this embodiment, the holding bracket 300 is removably attached to the side of the jet heater 101 via a second securing means 304, such as a screw, bolt, clamp, etc., or any other suitable securing means 304 as is known in the art.

Figure 4:
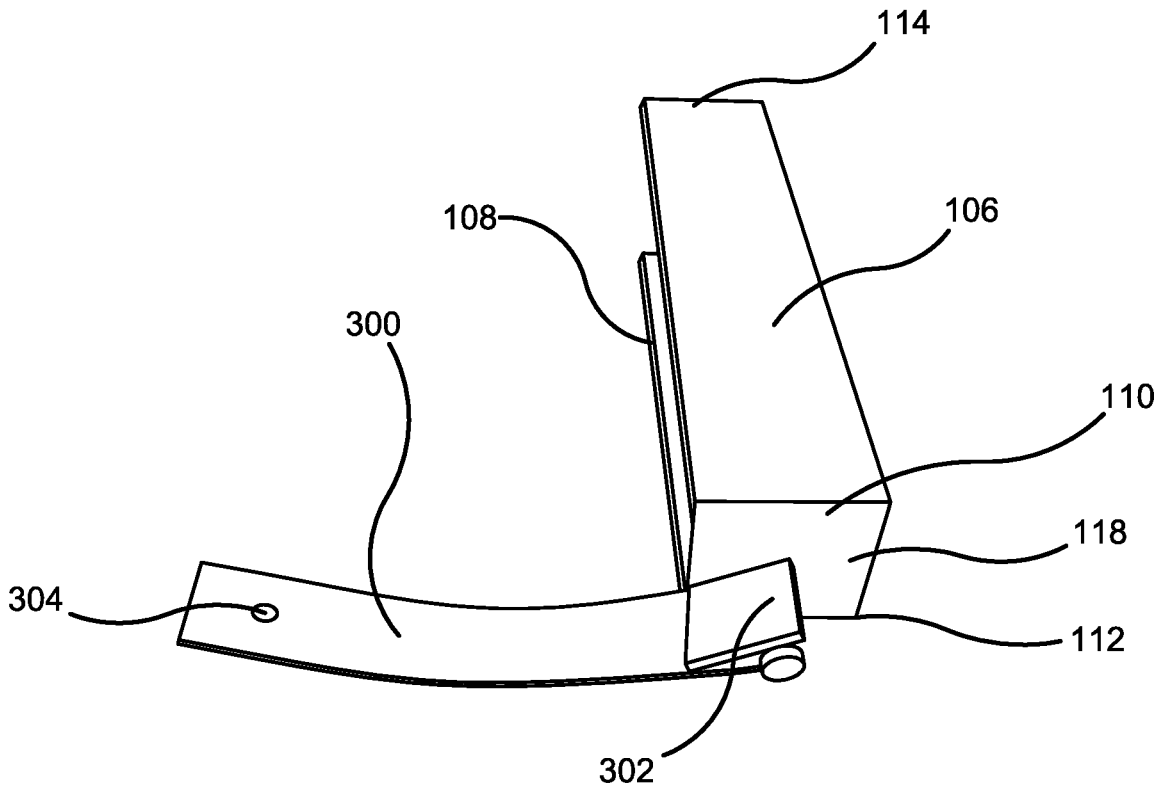
FIG. 4 illustrates a side perspective view of one potential embodiment of the diverter device of the present invention disclosing the clamp in accordance with the disclosed architecture.

FIG. 4 illustrates a perspective view of another embodiment of the diverter device 100 of the present invention. In this embodiment, the diverter device 100 and its components are manufactured from stainless steel, aluminum, powder-coated metals, or any other suitable metals as is known in the art. Preferably, the device 100 comprises a generally stainless-steel U-shaped component 102 that is secured to a jet heater 101, allowing users to reposition the device 100 as needed. The device 100 allows users to adjust the airflow from a jet heater 101 in several different ways by simply rotating or repositioning the stainless-steel U-shaped component 102.

Figure 5:
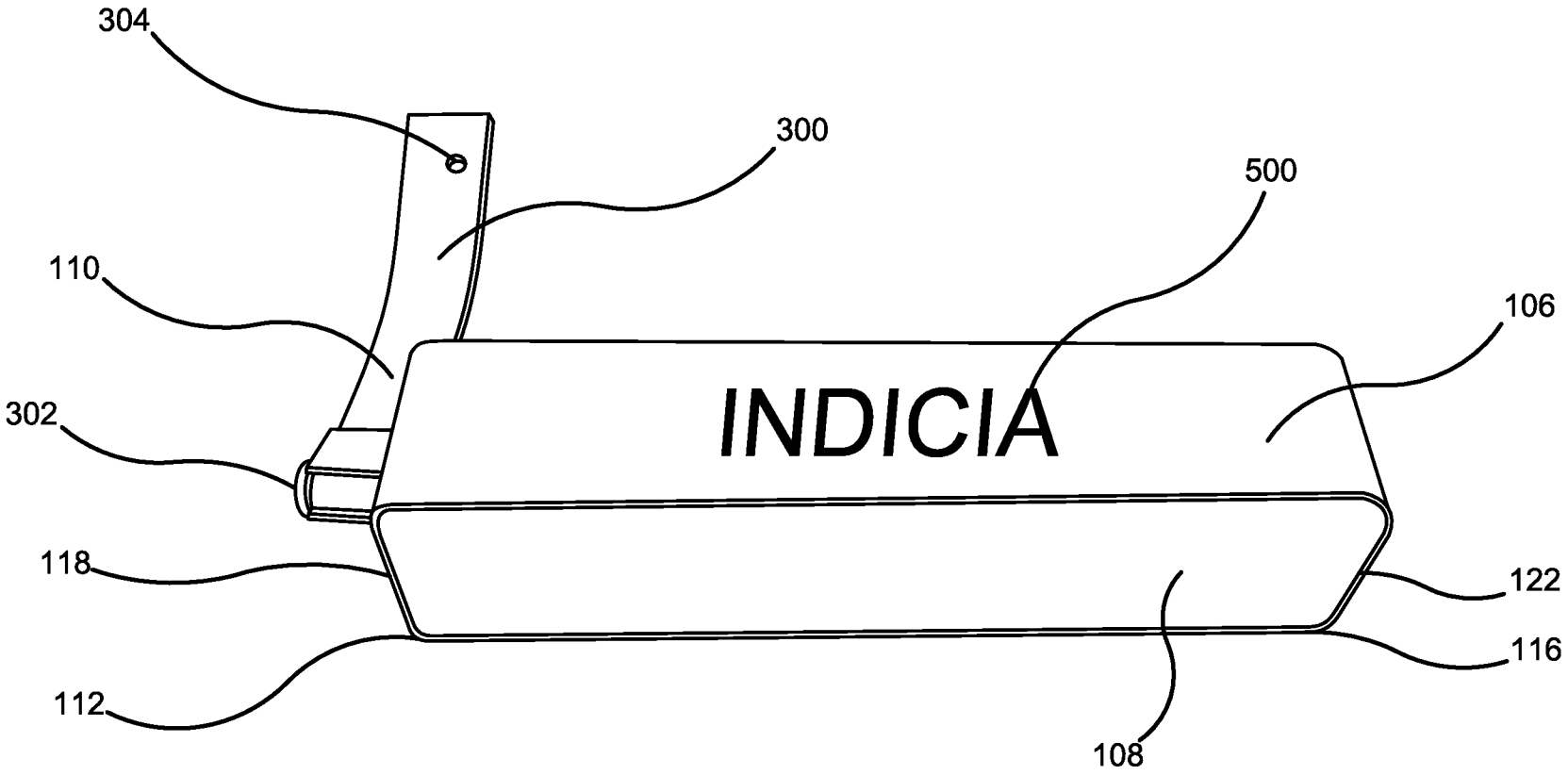
FIG. 5 illustrates a back perspective view of one potential embodiment of the diverter device of the present invention disclosing the U-shaped component in accordance with the disclosed architecture.

FIG. 5 illustrates a perspective view of another embodiment of the diverter device 100 of the present invention. In this embodiment, the diverter device 100 comprises a plurality of indicia 500 on the U-shaped component 102. Specifically, the U-shaped component 102 may include advertising, a trademark, or other letters, designs, or characters, printed, painted, stamped, or integrated into the device 100, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be heating or brand related.

Figure 6:
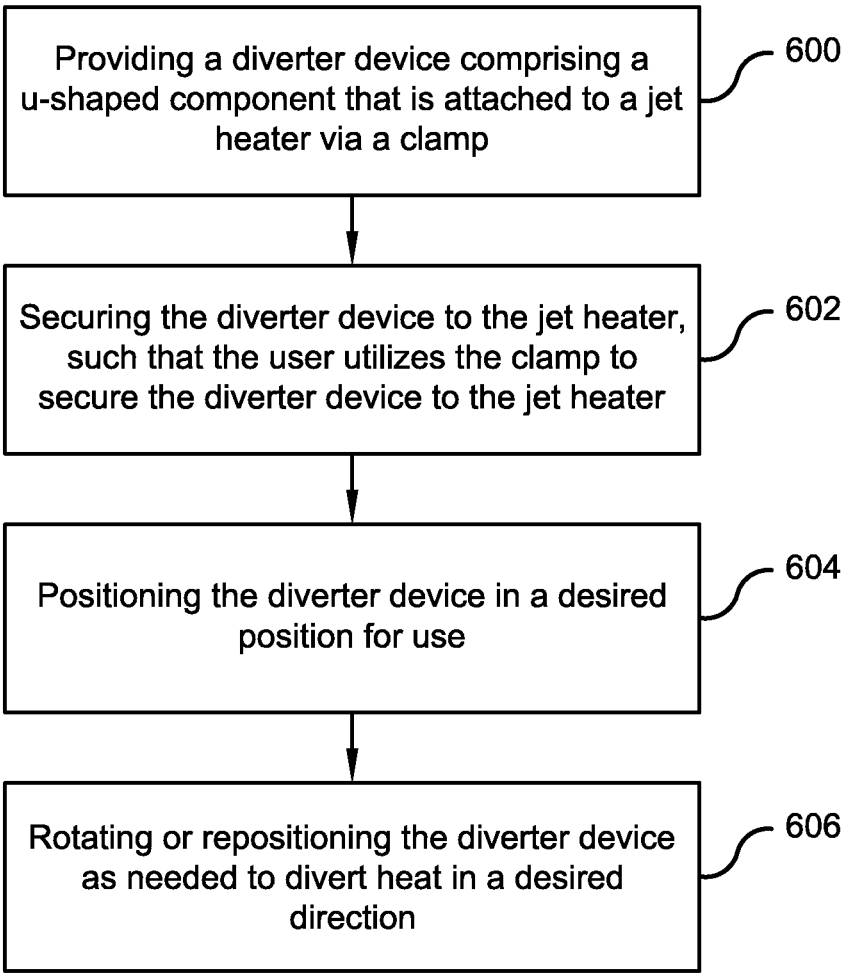
FIG. 6 illustrates a flowchart showing a method of diverting airflow from a jet heater by using one potential embodiment of the diverter device of the present invention in accordance with the disclosed architecture.

FIG. 6 illustrates a flowchart of the method of diverting airflow from a jet heater. The method includes the steps of at 600, providing a diverter device comprising a U-shaped component that is attached to a jet heater via a clamp. The method also comprises at 602, securing the diverter device to the jet heater, such that the user utilizes the clamp to secure the diverter device to the jet heater. Further, the method comprises at 604, positioning the diverter device in a desired position for use. Finally, at 606, rotating and/or repositioning the diverter device as needed to divert the heat in a desired direction.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "diverter device" and "device" are interchangeable and refer to the diverter device 100 of the present invention.

Notwithstanding the foregoing, the diverter device 100 of the present invention can be of any suitable size and configuration as is known in the art without affecting the overall concept of the invention, provided that it accomplishes the above stated objectives. One of ordinary skill in the art will appreciate that the diverter device 100 as shown in FIGS. 1-6 is for illustrative purposes only, and that many other sizes and shapes of the diverter device 100 are well within the scope of the present disclosure. Although the dimensions of the diverter device 100 are important design parameters for user convenience, the diverter device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A diverter device for diverting a heat from a jet heater in a desired direction, the diverter device comprising:

a component comprising a top wall and a bottom wall secured together via a side wall;

a second side wall; and a holding bracket, wherein the holding bracket is secured to the side wall via a securing component, and further wherein the holding bracket allows a user to reposition the diverter device as needed;

wherein the top wall comprises a first end and a second end;

wherein the bottom wall comprises a first end and a second end;

wherein the side wall is secured at the first end of the top wall and the first end of the bottom wall;

wherein the component is open in a center to allow a quantity of air to flow through;

wherein the second side wall is secured at the second end of the top wall and the second end of the bottom wall to form an oval-shaped structure;

wherein the holding bracket is secured to the side wall via a clamp;

wherein the holding bracket extends outwardly from and perpendicular to the side wall;

wherein the top and bottom walls span a width of an outlet of the jet heater;

wherein the holding bracket contacts a side of the jet heater; and further wherein the holding bracket is removably secured to the side of the jet heater via a screw.

2. The diverter device of claim 1, wherein the top wall and the bottom wall are flat, planar structures.

3. The diverter device of claim 1 further comprising a plurality of indicia on the component.

4. A diverter device for diverting a heat from a jet heater in a desired direction, the diverter device comprising:

a U-shaped component;

a side wall; and a holding bracket;

wherein the U-shaped component is comprised of a top wall, a bottom wall and a side wall;

wherein the top wall comprises a first end and a second end, and the bottom wall comprises a first end and a second end;

wherein the side wall is secured at the first end of the top wall and the first end of the bottom wall to form a U-shaped structure;

wherein the holding bracket is secured to the side wall via a securing component and extends out perpendicularly to the side wall;

wherein the holding bracket allows a user to reposition the diverter device as needed;

wherein the U-shaped component is open in a center to allow a quantity of air to flow through; and wherein the second side wall is secured at the second end of the top wall and the second end of the bottom wall;

wherein the holding bracket is secured to the side wall via a clamp;

wherein the holding bracket extends outwardly from and perpendicular to the side wall;

wherein the top and bottom walls span a width of an outlet of the jet heater;

wherein the holding bracket contacts a side of the jet heater; and wherein the holding bracket is removably secured to the side of the jet heater via a screw.

5. The diverter device of claim 4 further comprising a plurality of indicia on the U-shaped component.

* * * * *